US005186670A

United States Patent [19]

Doan et al.

[11] Patent Number: 5,186,670

[45] Date of Patent: Feb. 16, 1993

[54] METHOD TO FORM SELF-ALIGNED GATE STRUCTURES AND FOCUS RINGS

[75] Inventors: Trung T. Doan; Tyler A. Lowrey; David A. Cathey; J. Brett Rolfson, all of Boise, Id.

[73] Assignee: Micron Technology, Inc., Boise, Id.

[21] Appl. No.: 844,369

[22] Filed: Mar. 2, 1992

[51] Int. Cl.[5] ..... H01J 9/04

[52] U.S. Cl. ..... 445/24; 445/50

[58] Field of Search ..... 445/24, 49, 50

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,812,559 | 5/1974 | Spindt et al. | 29/25.18 |
| 3,875,442 | 4/1975 | Wasa et al. | 313/193 |
| 3,970,887 | 7/1976 | Smith et al. | 313/309 |
| 4,168,213 | 9/1979 | Hoeberechts | 156/659 |
| 4,193,226 | 3/1980 | Gill, Jr. et al. | 51/124 R |
| 4,943,343 | 7/1990 | Bardai et al. | 156/643 |
| 4,988,637 | 1/1991 | Dhong et al. | 437/60 |
| 5,070,282 | 12/1991 | Epsztein et al. | 315/383 |
| 5,081,421 | 1/1992 | Miller et al. | 156/627 |

FOREIGN PATENT DOCUMENTS

| | | | |
|---|---|---|---|
| 2209432 | 5/1989 | United Kingdom | 445/50 |

*Primary Examiner*—Richard K. Seidel
*Assistant Examiner*—Jeffrey T. Knapp
*Attorney, Agent, or Firm*—Lia M. Pappas

[57] ABSTRACT

A selective etching and chemical mechanical planarization process for the formation of self-aligned gate and focus ring structures surrounding an electron emission tip for use in field emission displays in which the emission tip is i) optionally sharpened through oxidation, ii) deposited with a first conformal layer, iii) deposited with a conductive material layer, iv) deposited with a second conformal insulating layer, v) deposited with a focus electrode ring material layer, vi) optionally deposited with a buffering material, vii) planarized with a chemical mechanical planarization (CMP) step, to expose a portion of the second conformal layer, viii) etched to form a self-aligned gate and focus ring, and thereby expose the emitter tip, afterwhich xi) the emitter tip may be coated with a low work function material.

20 Claims, 8 Drawing Sheets

METHOD TO FORM SELF-ALIGNED GATE STRUCTURES AND FOCUS RINGS

FIELD OF THE INVENTION

This invention relates to field emission devices, and more particularly to processes for creating gate and focus ring structures which are self-aligned to the emitter tips using chemical mechanical planarization (CMP) and etching techniques.

BACKGROUND OF THE INVENTION

Cathode ray tube (CRT) displays, such as those commonly used in desk-top computer screens, function as a result of a scanning electron beam from an electron gun, impinging on phosphors on a relatively distant screen. The electrons increase the energy level of the phosphors. When the phosphors return to their normal energy level, they release the energy from the electrons as a photon of light, which is transmitted through the glass screen of the display to the viewer.

Flat panel displays have become increasingly important in appliances requiring lightweight portable screens. Currently, such screens use electroluminescent or liquid crystal technology. A promising technology is the use of a matrix-addressable array of cold cathode emission devices to excite phosphor on a screen.

In U.S. Pat. No. 3,875,442, entitled "Display Panel," Wasa et. al. disclose a display panel comprising a transparent gas-tight envelope, two main planar electrodes which are arranged within the gas-tight envelope parallel with each other, and a cathodoluminescent panel. One of the two main electrodes is a cold cathode, and the other is a low potential anode, gate, or grid. The cathode luminescent panel may consist of a transparent glass plate, a transparent electrode formed on the transparent glass plate, and a phosphor layer coated on the transparent electrode. The phosphor layer is made of, for example, zinc oxide which can be excited with low energy electrons. This structure is depicted in FIG. 1.

Spindt, et. al. discuss field emission cathode structures in U.S. Pat. Nos. 3,665,241, and 3,755,704, and 3,812,559. To produce the desired field emission, a potential source is provided with its positive terminal connected to the gate, or grid, and its negative terminal connected to the emitter electrode (cathode conductor substrate). The potential source may be made variable for the purpose of controlling the electron emission current. Upon application of a potential between the electrodes, an electric field is established between the emitter tips and the low potential anode grid, thus causing electrons to be emitted from the cathode tips through the holes in the grid electrode.

An array of points in registry with holes in low potential anode grids are adaptable to the production of cathodes subdivided into areas containing one or more tips from which areas emissions can be drawn separately by the application of the appropriate potentials thereto.

The clarity, or resolution, of a field emission display is a function of a number of factors, including emitter tip sharpness, alignment and spacing of the gates, or grid openings, which surround the tips, pixel size, as well as cathode-to-gate and cathode-to-screen voltages. These factors are also interrelated. Another factor which effects image sharpness is the angle at which the emitted electrons strike the phosphors of the display screen.

The distance (d) that the emitted electrons must travel from the baseplate to the faceplate is typically on the order of several hundred microns. The contrast and brightness of the display are optimized when the emitted electrons impinge on the phosphors located on the cathodoluminescent screen, or faceplate, at a substantially 90° angle. However, the contrast and brightness of the display are not currently optimized due to the fact that the initial electron trajectories assume a substantially conical pattern having an apex angle of roughly 30°, which emanates from the emitter tip. In addition, the space-charge effect results in coulombic repulsion among emitted electrons, which tends to further dispersion within the electron beam, as depicted in FIG. 1.

U.S. Pat. No. 5,070,282 entitled, "An Electron Source of the Field Emission Type," discloses a "controlling electrode" placed downstream of the "extracting electrode." U.S. Pat. No. 4,943,343 entitled, "Self-aligned Gate Process for Fabricating Field Emitter Arrays," discloses the use of photoresist in the formation of self-aligned gate structures.

SUMMARY OF THE INVENTION

The object of the present invention is to enhance image clarity on flat panel displays through the use of self-aligned gate and focus ring structures in the fabrication of cold cathode emitter tips. Chemical mechanical planarization (CMP) and selective etching techniques are key elements of the fabrication process.

The focus rings of the present invention, which are similar to the focusing structures of CRTs, function to collimate the emitted electrons so that the beam impinges on a smaller spot on the display screen, as seen in FIG. 2.

One advantage of the process of the present invention is that it allows for the incorporation of focus rings into a cold cathode fabrication process, which provides enhanced collimation of electrons emitted from the cathode emitter tips, and results in improved display contrast and clarity.

Another advantage of the process of the present invention is the fabrication of the focus rings is accomplished in a self-aligned manner, which greatly reduces process variability, and decreases manufacturing costs.

BRIEF DESCRIPTION OF THE DRAWINGS

The process of the present invention will be better understood by reading the following description of nonlimitative embodiments, with reference to the attached drawings, wherein like parts in each of the several figures are identified by the same reference character, and which are briefly described as follows.

DETAILED DESCRIPTION OF THE INVENTION

Figure 1:
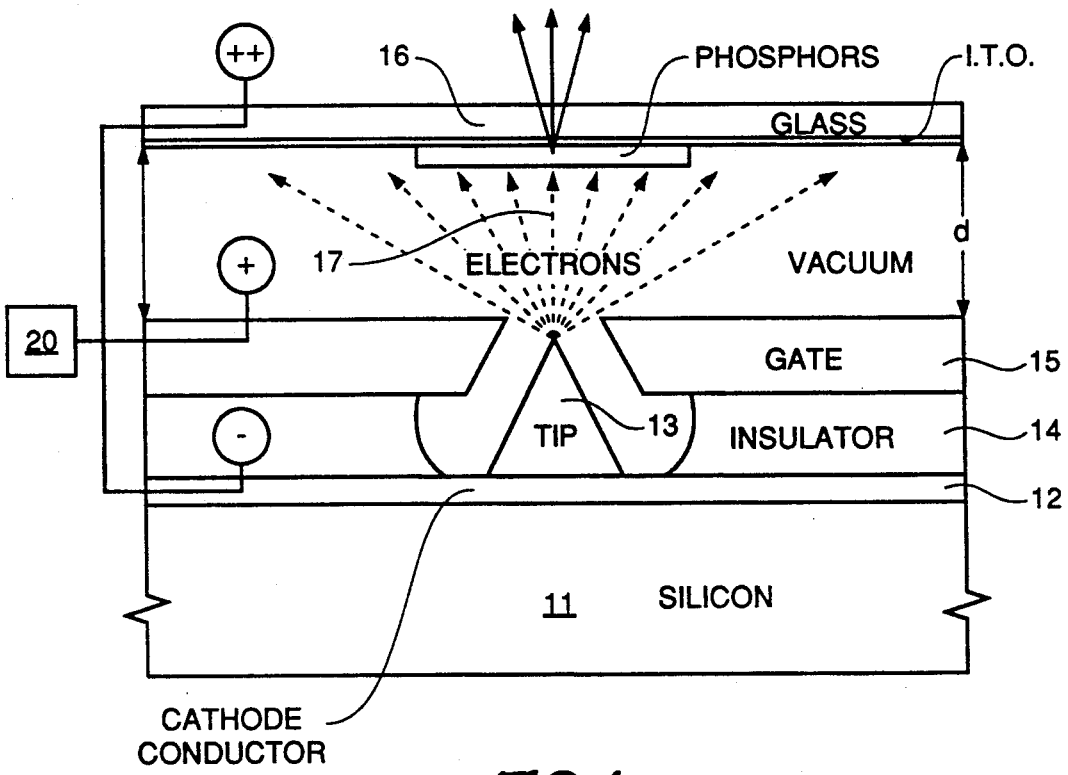
FIG. 1 is a cross-sectional schematic drawing of a flat panel display showing a field emission cathode which lacks the self-aligned focus rings of the present invention.

Referring to FIG. 1, a field emission display employing a cold cathode is depicted. The substrate 11 can be comprised of glass, for example, or any of a variety of other suitable materials. In the preferred embodiment, a single crystal silicon layer serves as a substrate 11 onto which a conductive material layer 12, such as doped polycrystalline silicon has been deposited. At a field emission site location, a conical micro-cathode 13 (also referred to herein as an emitter tip) has been constructed on top of the substrate 11. Surrounding the micro-cathode 13, is a low potential anode gate structure 15. When a voltage differential, through source 20, is applied between the cathode 13 and the gate 15, an electron stream 17 is emitted toward a phosphor coated screen 16. The screen 16 functions as the anode. The electron stream 17 tends to be divergent, becoming wider at greater distances from the tip of cathode 13. The electron emission tip 13 is integral with the single crystal semiconductor substrate 11, and serves as a cathode conductor. Gate 15 serves as a low potential anode or grid structure for its respective cathode 13. A dielectric insulating layer 14 is deposited on the conductive cathode layer 12. The insulator 14 also has an opening at the field emission site location.

Figure 2:
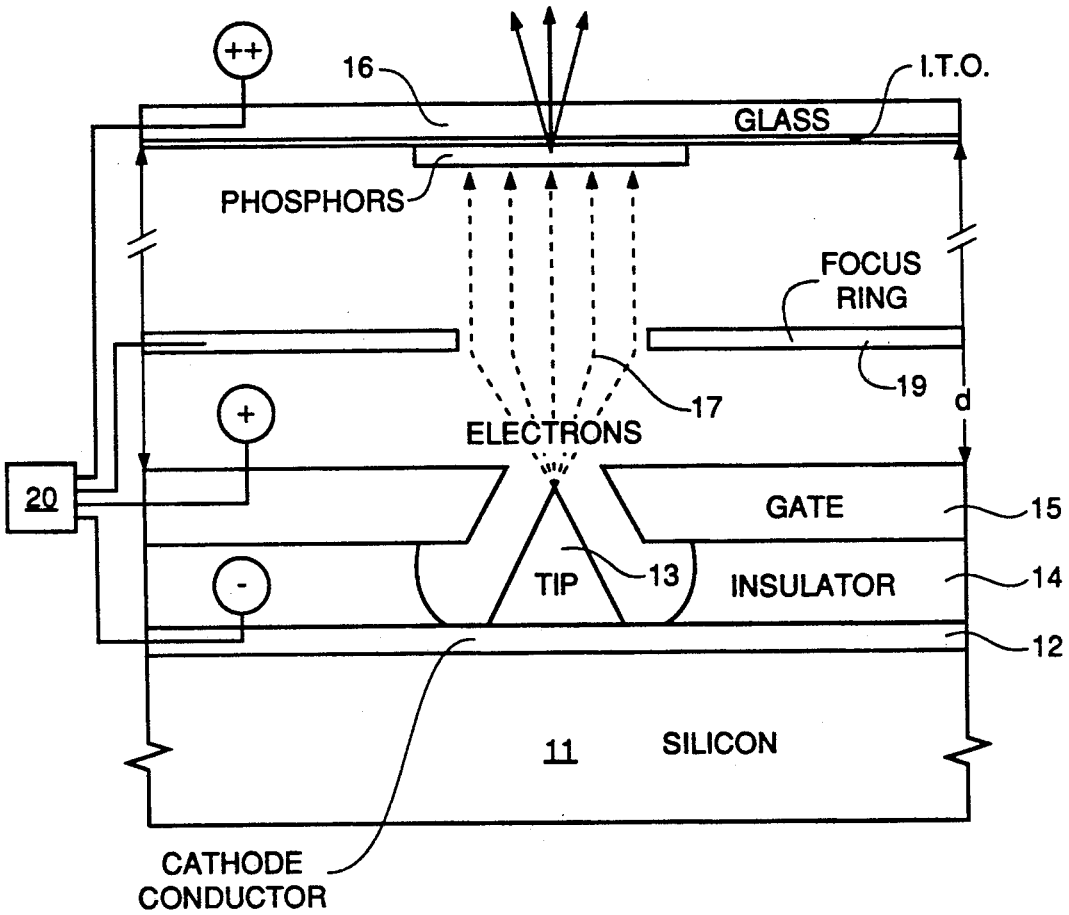
FIG. 2 is the flat panel display shown in FIG. 1, further depicting the added focus ring structures of the present invention.

The cathode structure of FIG. 2 is similar to FIG. 1. However, beam collimating focus ring structures 19 fabricated by the process of the present invention, are also depicted. The focus rings 19 collimate the electron beam 17 emitted from each cathode so as to reduce the area of the spot where the beam impinges on the phosphor coated screen 16, thereby improving image resolution.

The invention can best be understood with reference to FIGS. 3–8 of the drawings which depict the initial, intermediate and final structures produced by a series of manufacturing steps according to the invention.

There are several methods by which to form the electron emission tips (Step A of FIG. 8) employed in the process of the present invention. Examples of such methods are presented in U.S. Pat. No. 3,970,887 entitled "Microstructure Field Emission Electron Source."

In practice, a single crystal P-type silicon wafer having formed therein (by suitable known doping pretreatment) a series of elongated, parallel extending opposite N-type conductivity regions, or wells. Each N-type conductivity strip has a width of approximately 10 microns, and a depth of approximately 3 microns. The spacing of the strips is arbitrary and can be adjusted to accommodate a desired number of field emission cathode sites to be formed on a given size silicon wafer substrate. (Processing of the substrate to provide the P-type and N-type conductivity regions may be by may well-known semiconductor processing techniques, such as diffusion and/or epitaxial growth.) If desired the P-type and N-type regions, of course, can be reversed through the use of a suitable starting substrate and appropriate dopants.

The wells, having been implanted with ions will be the site of the emitter tips. A field emission cathode microstructure can be manufactured using an underlying single crystal, semiconductor substrate. The semiconductor substrate may be either P or N-type and is selectively masked on one of its surfaces where it is desired to form field emission cathode sites. The masking is done in a manner such that the masked areas define islands on the surface of the underlying semiconductor substrate. Thereafter, selective sidewise removal of the underlying peripheral surrounding regions of the semiconductor substrate beneath the edges of the masked island areas results in the production of a centrally disposed, raised, single crystal semiconductor field emitter tip in the region immediately under each masked island area defining a field emission cathode site. It is preferred that the removal of underlying peripheral surrounding regions of the semiconductor substrate be closely controlled by oxidation of the surface of the semiconductor substrate surrounding the masked island areas with the oxidation phase being conducted sufficiently long to produce sideways growth of the resulting oxide layer beneath the peripheral edges of the masked areas to an extent required to leave only a non-oxidized tip of underlying, single crystal substrate beneath the island mask. Thereafter, the oxide layer is differentially etched away at least in the regions immediately surrounding the masked island areas to result in the production of a centrally disposed, raised, single crystal semiconductor field emitter tip integral with the underlying single, crystal semiconductor substrate at each desired field emission cathode site.

Figure 8:
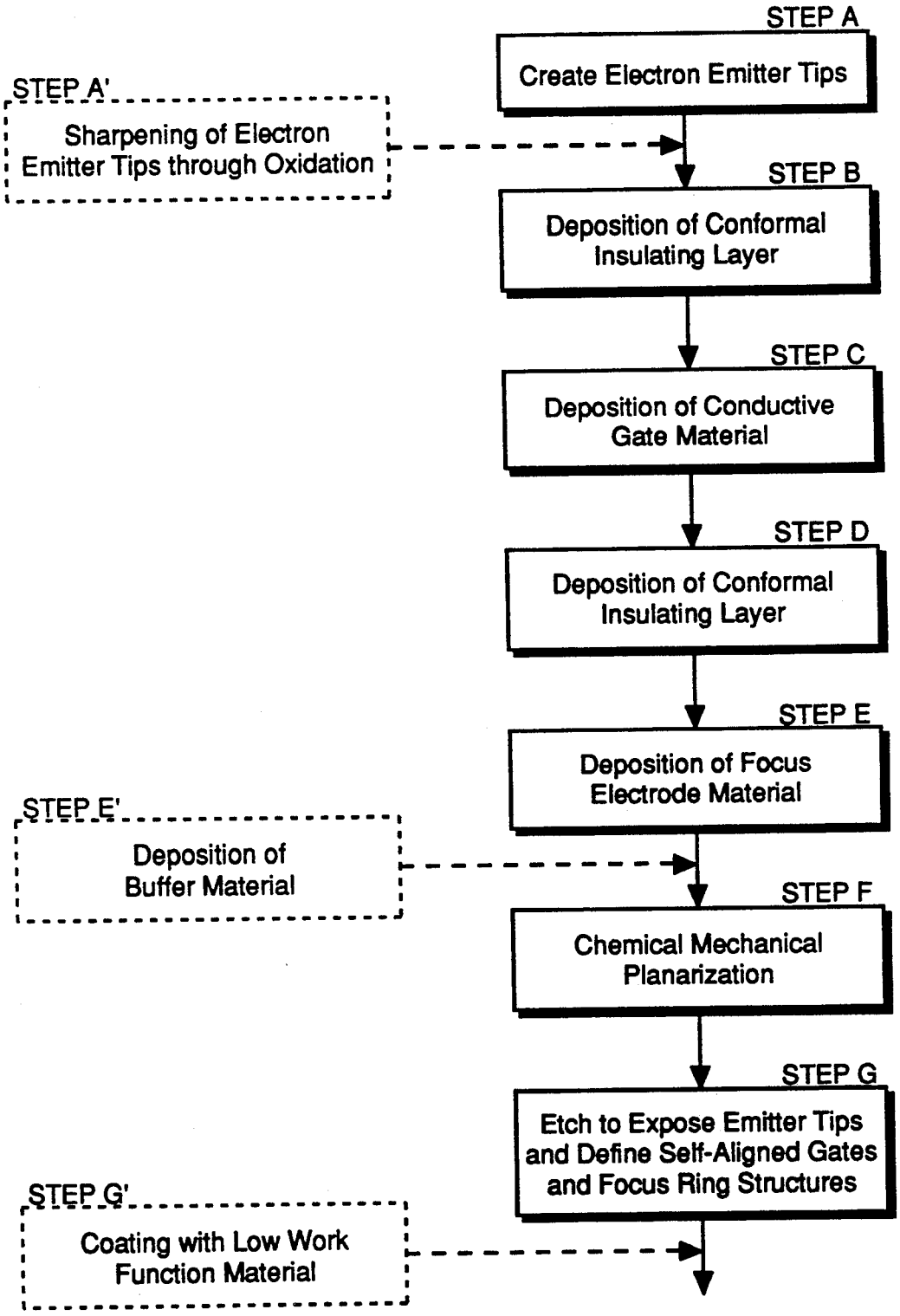
FIG. 8 is a flow diagram of the steps involved in the formation of self-aligned gate and focus-ring structures according to the present invention.

Before beginning the gate formation process, the tip of the electron emitter may be sharpened through an oxidation process (Step A' of FIG. 8). The surface of the silicon wafer (Si) 11 and the emitter tip 13 are oxidized to produce an oxide layer of $SiO_2$, which is then etched to sharpen the tip. Any conventional, known oxidation process may be employed in forming the $SiO_2$, and etching the tip.

Figure 3:
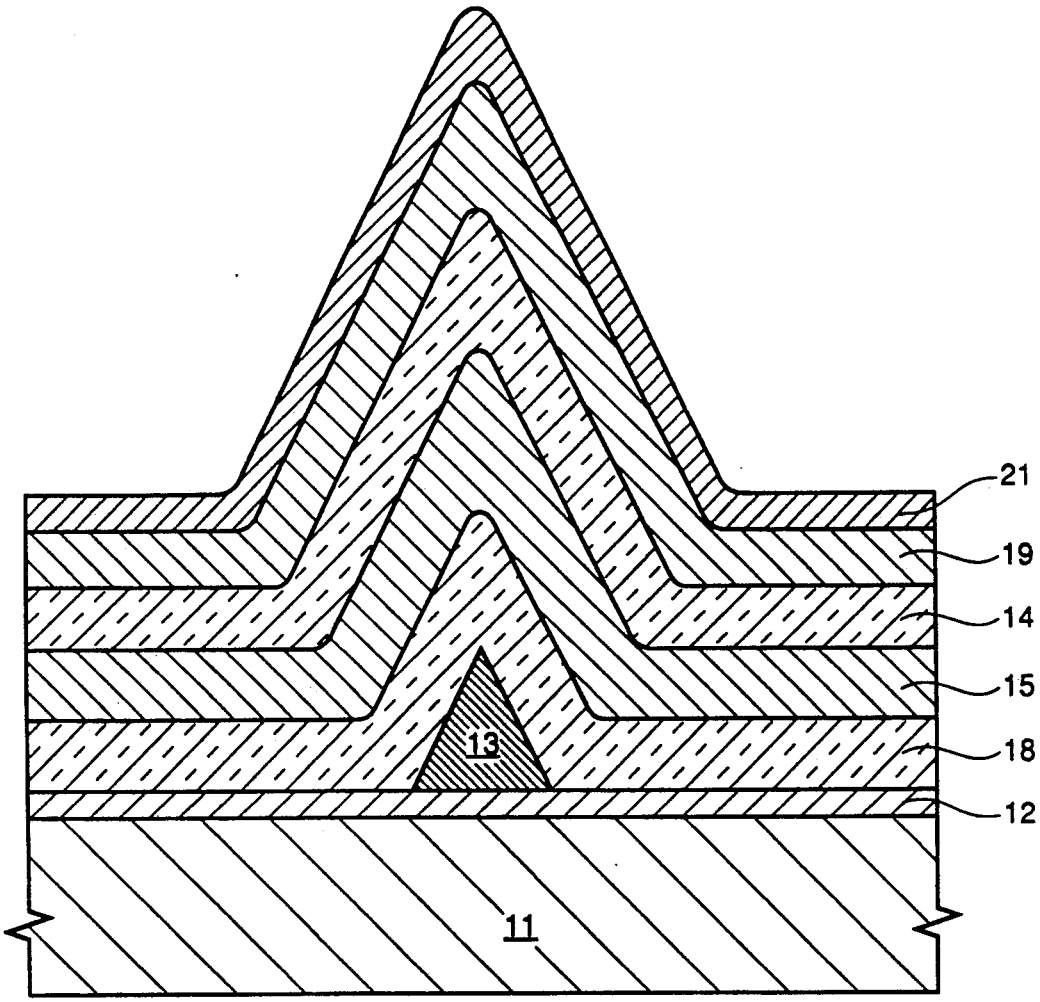
FIG. 3 shows a field emission cathode, having a substantially conical emitter tip, on which has been deposited a first insulating layer, a conductive layer, a second insulating layer, a focus electrode layer, and a buffer layer according to the present invention.

The next step (Step B of FIG. 8) is the deposition of a conformal insulating material which is selectively etchable with respect to the conductive gate material. In the preferred embodiment, a silicon dioxide layer 18 is used. Other suitable selectively etchable materials, including but not limited to, silicon nitride and silicon oxynitride may also be used. The thickness of this first insulating layer will substantially determine both the gate 15 to cathode 13 spacing, as well as the gate 15 to substrate spacing 11. Hence, the insulating layer must be as thin as possible, since small gate 15 to cathode 13 distances result in lower emitter drive voltages, at the same time, the insulating layer must be large enough to prevent the oxide breakdown which occurs if the gate is not adequately spaced from the cathode conductor 12. The oxide insulating layer 18, as shown in FIG. 3, is a conformal insulating layer. The oxide is deposited on the emitter tip 13 in a manner such that the oxide layer conforms to the preferably conical shape of the cathode emitter tip 13.

The next step in the process (Step C of FIG. 8) is the deposition of the conductive gate material 15 (FIG. 3).

The gate is formed from a conductive layer. The conductive material layer 15 may comprise a metal, such as chromium or molybdenum, but the preferred material for this process is deemed to be doped polysilicon or silicided polysilicon.

At this stage in the fabrication ( Step D of FIG. 8), a second conformal insulating layer 14 is deposited (FIG. 3). The second conformal insulating layer 14 is substantially similar to the first insulating layer 18. The second insulating layer 14 may also comprise silicon dioxide, silicon nitride, silicon oxynitride, as well as any other suitable selectively etchable material. The second insulating layer 14 substantially determines the gate 15 to focus ring 19 spacing (FIGS. 2 and 3).

The next process step (Step E of FIG. 8), a focus electrode layer 19 is deposited (FIG. 3). The focus rings 19 (FIG. 2) will be formed from the focus electrode layer 19. The focus electrode material layer 19 is also a conductive layer which may be comprised of a metal, such as chromium or molybdenum, but as in the case with the conductive gate material layer 15, the preferred material is doped polysilicon or silicided polysilicon.

At this stage in the fabrication, (Step E' of FIG. 8) a buffer material 21 may be deposited to prevent the undesired etching of the lower-lying portions of the focus electrode material layer 19 during the chemical mechanical polishing (CMP) step (Step F of FIG. 8) which follows. It should be emphasized that the deposition of a buffering layer 21 is an optional step. A suitable buffering material is a thin layer of $Si_3N_4$. The nitride buffer layer 21 has the effect of enhancing the strength of the tip 13, which is one advantage of performing this optional step. The buffering layer 21 substantially impedes the progress of the CMP into the layer on which the buffering material 21 is deposited.

The next step in the gate formation process (STEP F of FIG. 8) is the chemical mechanical planarization (CMP), also referred to in the art as chemical mechanical polishing (CMP). Through the use of chemical and abrasive techniques, the buffer material as well as any other layers (e.g. the peaks of the focus electrode layer, the conformal insulating layers and the conductive gate layer) extending beyond the emitter tip 13 are "polished" away.

In general, CMP involves holding or rotating a wafer of semiconductor material against a wetted polishing surface under controlled chemical slurry, pressure, and temperature conditions. A chemical slurry containing a polishing agent such as alumina or silica may be utilized as the abrasive medium. Additionally, the chemical slurry may contain chemical etchants. This procedure may be used to produce a surface with a desired endpoint or thickness, which also has a polished and planarized surface. Such apparatus for polishing are disclosed in U.S. Pat. Nos. 4,193,226 and 4,811,522. Another such apparatus is manufactured by Westech Engineering and is designated as a Model 372 Polisher.

CMP will be performed substantially over the entire wafer surface, and at a high pressure. Initially, CMP will proceed at a very fast rate, as the peaks are being removed, then the rate will slow dramatically after the peaks have been substantially removed. The removal rate of the CMP is proportionally related to the pressure and the hardness of the surface being planarized.

Figure 4:
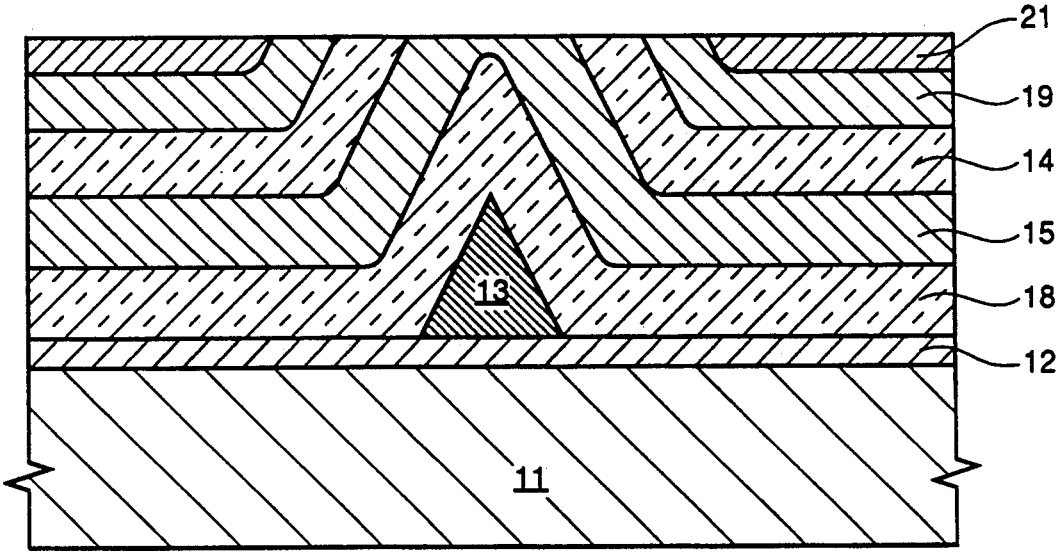
FIG. 4 shows the multi-layer structure of FIG. 3 after it has undergone chemical mechanical planarization (CMP), according to the present invention.

FIG. 4 illustrates the intermediate step in the gate formation process following the chemical mechanical planarization CMP. A substantially planar surface is achieved, and the second conformal insulating layer 14 is thereby exposed. At this point, (Step G of FIG. 8) the various layers can be selectively etched to expose the emitter tip 13 and define the self-aligned gate 15 and focus ring 19 structures using any of the various etching techniques known in the art. As a result of the CMP process, the order of layer removal can also be varied.

Figure 5:
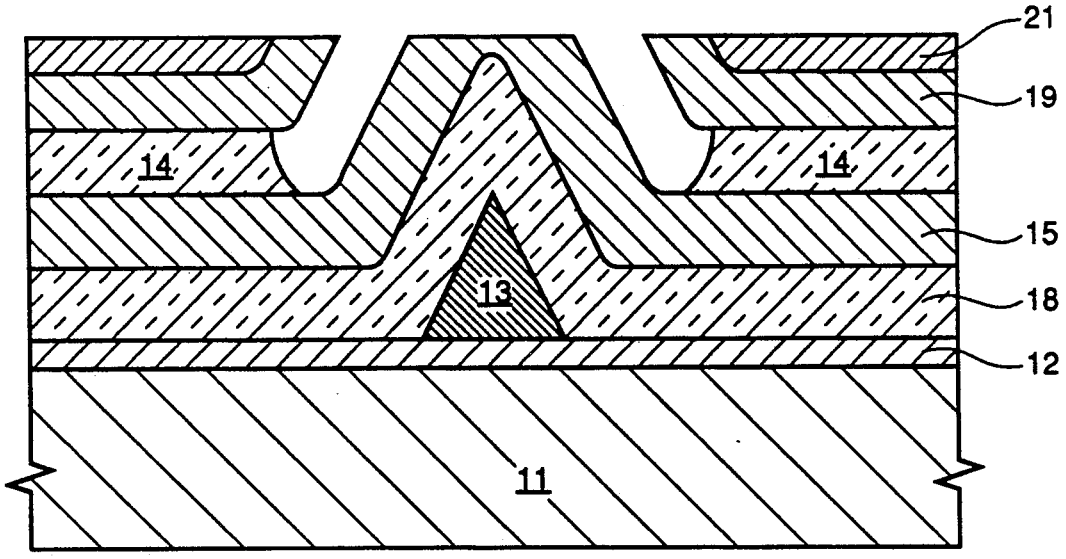
FIG. 5 shows the structure of FIG. 4, after a first etching, according to the present invention.

In the preferred embodiment, the second insulating layer 14 is selectively etched to expose the gate. FIG. 5 shows the means by which the second conformal insulating layer 14 defines the gate 15 to focus ring 19 spacing, as well as the means by which the gate 15 and the focus rings 19 become self-aligned.

Figure 6:
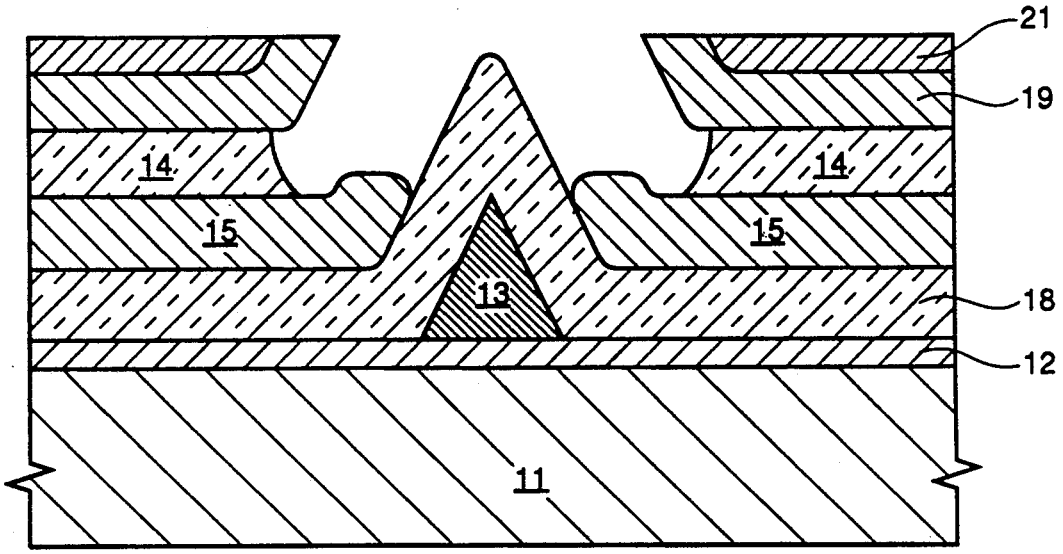
FIG. 6 shows the structure of FIG. 5, after a second etching, according to the present invention.

The gate material layer 15 is then etched, as shown in FIG. 6. After the gate material layer 15 is removed, the first conformal insulating layer 18 which covers the emitter tip 13 is exposed.

Figure 7:
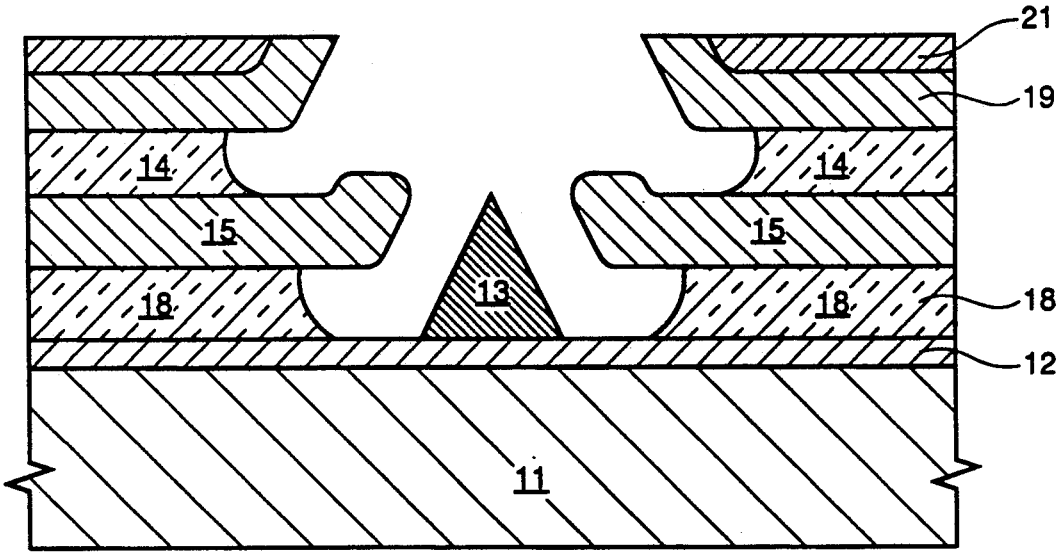
FIG. 7 shows the structure of FIG. 6, after wet etching, according to the present invention.

The next process step is a wet etching of the first selectively etchable insulating layer 18 to expose the emitter tip 13. FIG. 7 illustrates the field emitter device after the insulating cavity has been so etched.

In an alternative embodiment, (not shown) the gate material layer 15 can be removed first, thereby exposing the first insulating layer 18. Both of the selectively etchable insulating layers can then be removed at the same time, thereby exposing the emitter tip 13.

If desired, the cathode tip 13 may optionally be coated with a low work function material (Step G' of FIG. 8). Low work function materials include, but are not limited to cermet ($Cr_3Si+SiO_2$), cesium, rubidium, tantalum nitride, barium, chromium silicide, titanium carbide, molybdenum, and niobium. Coating of the emitter tips may be accomplished in one of many ways. The low work function material or its precursor may be deposited through sputtering or other suitable means on the tip 13. Certain metals (e.g., titanium or chromium) may be reacted with the silicon of the tip to form silicide during a rapid thermal processing (RTP) step. Following the RTP step, any unreacted metal is removed from the tip 13. In a nitrogen ambient, deposited tantalum may be converted during RTP to tantalum nitride, a material having a particularly low work function. The coating process variations are almost endless. This results in an emitter tip 13 that may not only be sharper than a plain silicon tip, but that also has greater resistance to erosion and a lower work function. The silicide is formed by the reaction of the refractory metal with the underlying polysilicon by an anneal step.

Figure 3A:
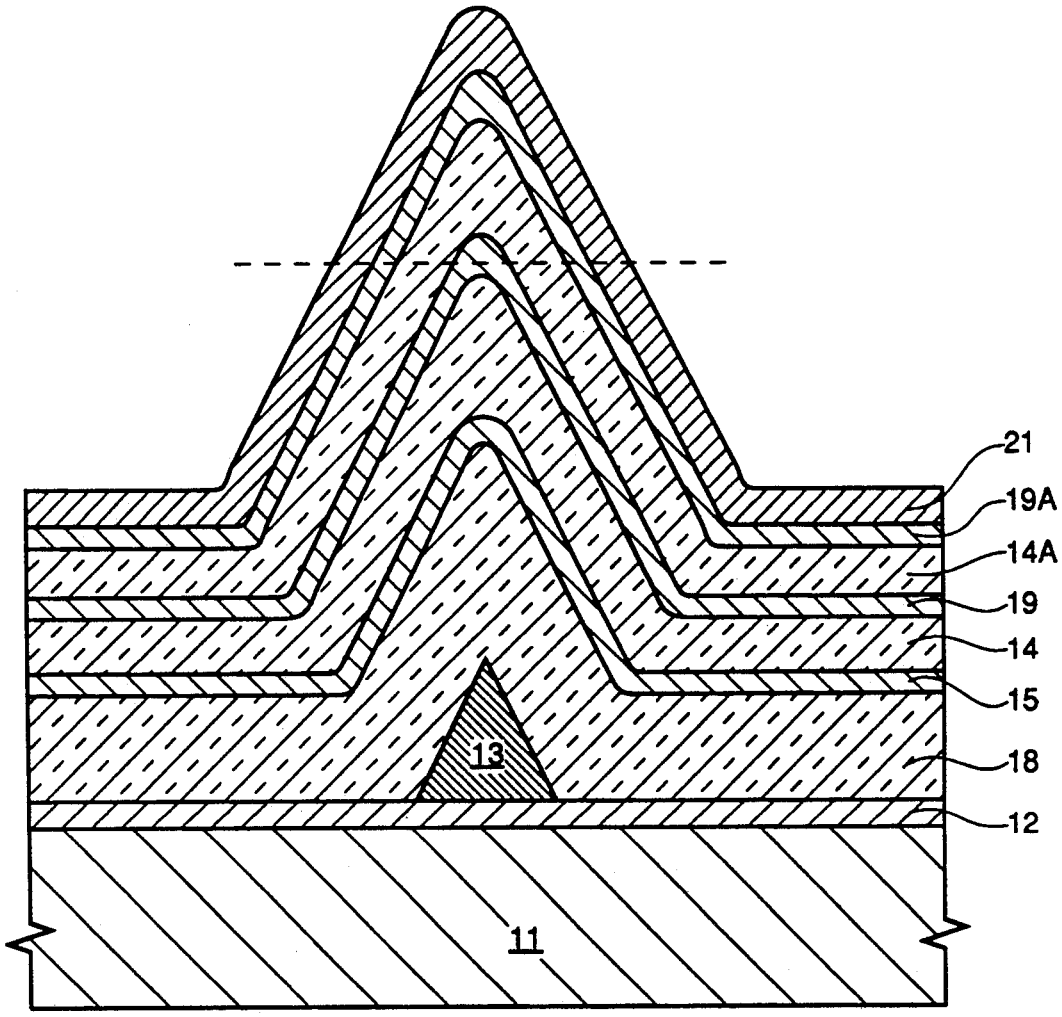
FIG. 3A shows the field emission cathode of FIG. 3, further illustrating multiple insulating layers and focus electrode layers.
Figure 7A:
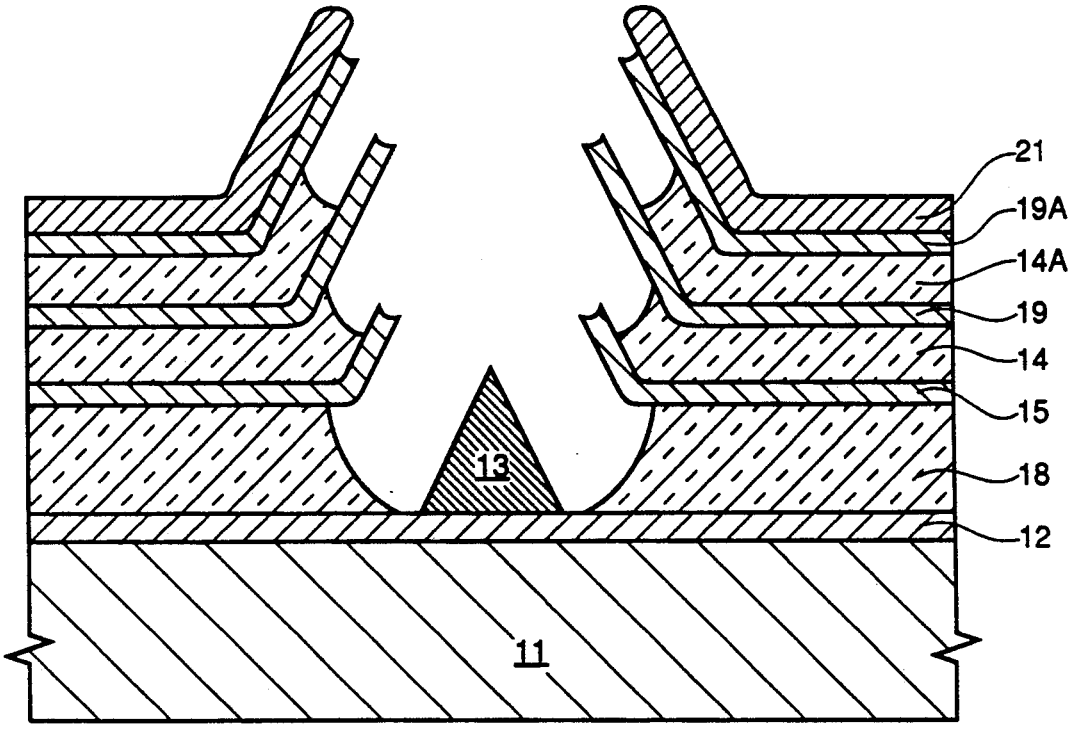
FIG. 7A shows the structure of FIG. 3A, after wet etching according to the present invention.

It is believed obvious to one skilled in the art that the manufacturing method described above is capable of considerable variation. For example, it is possible to fabricate several focus ring structures by adding successive insulating layers 14, **14*a*, etc., and conductive layers 19, 19*a*, etc. prior to the CMP step, (the relative level of the planarization step being indicated by the dotted line) and thereafter selectively etching the layers to expose the emitter tips 13, as shown in FIGS. 3A and 7A**.

All of the U.S. patents cited herein are hereby incorporated by reference herein as if set forth in their entirety.

While the particular process as herein shown and disclosed in detail is fully capable of obtaining the objects and advantages herein before stated, it is to be understood that it is merely illustrative of the presently understood embodiments of the invention and that no limitations are intended to the details of construction or design herein shown other than as described in the appended claims.

We claim:

1. A process for the formation of self-aligned gate and focus ring structures around a cold cathode emitter tip, said process comprising the following steps:

processing a wafer to form at least one conical cathode on a substrate, said cathode having an emitter tip;

depositing a first conformal insulating layer over the surface of the wafer;

depositing a conductive material layer superjacent said first conformal insulating layer;

depositing a second conformal insulating layer superjacent said conductive material layer;

depositing a focus electrode material layer superjacent said second conformal insulating layer;

subjecting the wafer to chemical mechanical planarization (CMP) to expose at least a portion of said conductive material layer; and etching said layers to expose the emitter tip.

2. The process according to claim wherein said first and second conformal insulating layers are selectively etchable with respect to said conductive material layer and said focus electrode layer.

3. The process according to claim 2, wherein said conductive material layer and said focus electrode material layer comprise at least one of doped polysilicon and silicized silicon.

4. The process according to claim 3, wherein the chemical mechanical planarization (CMP) step is performed with an abrasive compound in a polishing slurry.

5. The process according to claim 4, further comprising the step of depositing a buffering material layer on said focus electrode material layer prior to subjecting the wafer to the chemical mechanical planarization (CMP) step 6. The process according to claim 5, further comprising the step of sharpening said tip by oxidation prior to depositing said first conformal insulating layer.

7. The process according to claim 6, wherein said buffering material layer comprises a thin layer of $Si_3N_4$.

8. The process according to claim 7, wherein said first and second conformal insulating layers comprise at least one of $SiO_2$, $Si_3N_4$, and silicon oxynitride.

9. The process according to claim 8, wherein said cathode is incorporated into an array of like cathodes as an optical display transmitter.

10. The process according to claim 9, wherein said etching further comprises the steps of:

etching said second conformal insulating layer to create a cavity between said conductive material layer and said focus electrode material layer;

etching said conductive material layer to form a gate; and removing a portion of said first conformal insulating layer surrounding the tip thereby exposing said tip.

11. The process according to claim 10, further comprising:

depositing additional said focus electrode material layers and additional said conformal insulating layers.

12. The process according to claim 9, wherein said etching further comprises the steps of:

etching said conductive material layer to form a gate; and etching said first and second conformal insulating layers simultaneously thereby exposing the emitter tip.

13. The process according to claim 12, further comprising:

depositing additional said focus electrode material layers and additional said conformal insulating layers.

14. A process for the formation of self-aligned gate and focus ring structures around a cold cathode tip, said process comprising the following steps:

processing a wafer to form at least one conical cathode on a substrate, said cathode having an emitter tip;

depositing at least two conformal insulating layers over the tip of said cathode;

depositing at least two conductive material layers superjacent said conformal insulating layer;

subjecting the wafer to chemical mechanical planarization (CMP); and removing said layers to expose the emitter tip.

15. The process according to claim 14, wherein the chemical mechanical planarization step is performed with an abrasive compound in a polishing slurry.

16. The process according to claim 15 further comprising the step of depositing a buffering material layer prior to subjecting the wafer to the chemical mechanical planarization (CMP) step.

17. The process according to claim 16, wherein said removing further comprises the step of:

etching said at least two conformal insulating layers thereby defining the gate and the focus ring structures.

18. The process according to claim 17, wherein said conformal insulating layers are selectively etchable with respect to said conductive material layers.

19. The process according to claim 18, further comprising the step of coating said tip with a material having a low work function.

20. A process for the formation of self-aligned gate and focus ring structures around an electron emitting cold cathode tip, said process comprising the following steps:

processing a wafer to form at least one cathode having an emitter tip;

depositing a first conformal insulating layer over the tip of said cathode;

depositing a conductive material layer superjacent said first conformal insulating layer;

depositing a second conformal insulating layer superjacent said conductive material layer;

depositing a focus electrode material layer superjacent said second conformal insulating layer;

subjecting the wafer to chemical mechanical planarization (CMP) to expose at least a portion of said second conformal insulating layer;

etching said second conformal insulating layer to create a cavity between said conductive material layer and said focus electrode material layer etching said conductive material layer to form a gate; and removing a portion of said first conformal insulating layer surrounding the tip thereby exposing said tip.

* * * * *